US006049998A

United States Patent [19]

Crouse et al.

[11] Patent Number: 6,049,998

[45] Date of Patent: Apr. 18, 2000

[54] APPARATUS AND METHOD FOR HIGH TEMPERATURE PRESSING FOLLOWED BY HIGH INTENSITY DRYING

[75] Inventors: Jere W. Crouse, Beloit; William J. Lenling, Madison, both of Wis.

[73] Assignee: Beloit Technologies Inc., Wilmington, Del.

[21] Appl. No.: 08/966,830

[22] Filed: Nov. 10, 1997

[51] Int. Cl.[7] ..... F26B 3/04

[52] U.S. Cl. ..... 34/445; 34/122

[58] Field of Search ..... 34/419, 425, 443, 34/444, 445, 114, 116, 117, 120, 122; 162/206, 207, 208

[56] References Cited

U.S. PATENT DOCUMENTS

| | | | |
|---|---|---|---|
| 4,874,469 | 10/1989 | Pulowski et al. | 162/358.5 |
| 4,880,502 | 11/1989 | Wedel | 162/358.5 |
| 5,127,168 | 7/1992 | Pikulik | 34/423 |
| 5,439,559 | 8/1995 | Crouse | 162/358.5 |
| 5,542,192 | 8/1996 | Deshpande et al. | 34/115 |
| 5,653,041 | 8/1997 | Ilmarinen et al. | 34/117 |
| 5,678,321 | 10/1997 | Deshpande et al. | 34/115 |

FOREIGN PATENT DOCUMENTS

| | | |
|---|---|---|
| 289447A | 11/1988 | European Pat. Off. . |
| 195 48 747 A1 | 7/1997 | Germany . |

*Primary Examiner*—Pamela A. Wilson

[57] ABSTRACT

A papermaking machine has a heated Extended Nip press following the pressing section. High temperature pressing raises the exit solids out of the press to 55 to 65 percent. The web then enters a high intensity dryer section where the web is pressed onto a dryer roll in intimate contact with the roll where it is dried up to approximately 90 percent solids. A coating on the dryer roll and the Extended Nip backing roll is composed of ceramic, metal and a fluorocarbon to allow the web to be separated from the backing roll and the dryer roll with ease. The dryer roll is internally heated by steam or preferably gas to between 200° F. and 500° F. An aircap positioned over the web on the dryer blows hot air at a temperature of 200–500° F. at a velocity of 15,000 to 30,000 feet per minute onto the web.

18 Claims, 3 Drawing Sheets

APPARATUS AND METHOD FOR HIGH TEMPERATURE PRESSING FOLLOWED BY HIGH INTENSITY DRYING

FIELD OF THE INVENTION

The present invention relates to papermaking machines in general, and more particularly, to pressing and drying sections of a papermaking machine.

BACKGROUND OF THE INVENTION

Paper is made as a continuous web on a papermaking machine. The machine has a wet end where papermaking stock, composed of over 99 percent water is fed onto a moving wire screen known as a Fourdrinier. In order to produce a more one-sided web, two forming fabrics are often used in what is known as a "Twin Wire Former" where water is drained from both sides to form the web. After the water drains through the screen or screens it leaves a thin sheet of fibers forming the web of paper. The web as formed still contains over 80 percent water. From the forming screen or wire the web is moved through a pressing section where water is pressed from the web. Upon leaving the pressing section, the web of paper is still composed of approximately 60–65 percent water. The pressed web is then dried on a series of steam heated drums before being wound onto a reel at the dry end of the papermaking machine.

In forming a paper web it is important, particularly in the lighter weight grades of paper used for printing newspapers and magazines, that both sides of the sheet of paper formed be essentially identical. Paper which has similar attributes on both surfaces can readily be printed on both sides with a uniform result. Where both sides of a paper sheet are essentially identical the paper is referred to as one-sided. Two-sided paper, where the properties of each side differ significantly, is undesirable and can result from more water being removed from one side of the web than the other in the pressing section. Pressing sections are therefore generally designed to maintain one-sidedness in the web of paper being formed.

Drying paper requires more energy than pressing the water from the paper web. On high speed modern papermaking machines where the web may move through the machine at speeds in excess of 6,000 feet per minute, the length of the dryer section needed can become excessively long in order to dry the rapidly moving web. This has led to the use of high temperature press rolls. High temperature press rolls of either the conventional or Extended Nip® press (ENP) manufactured by Beloit Corporation, of Beloit, Wis., can increase the dryness of the paper, significantly reducing the amount of drying required. However, a portion of a conventional dryer section is still required.

A recently developed technique for increasing the rate of drying of a paper web is described in U.S. Pat. No. 5,127,168 to Pikulik. The described technique involves pressing a paper web into intimate contact with a dryer roll which increases the rate of heat transfer from the dryer drum to the web. The adhesion of the web to the dryer rolls allows the use of aircaps on the dryer rolls to increase the rate of drying.

Increasing the drying rate of a paper web being formed is an important development. Improvements in papermaking technology have in the past resulted in wider machines running at higher speeds. Accompanying these improvements the papermaking machines themselves have increased in size. The future appears to be in papermaking machines which operate at much higher speed and employ high intensity pressing and drying sections which significantly reduce the overall size of the papermaking machine. At the same time that the papermaking machine is getting shorter the quality of the fibers used to manufacture paper is decreasing because of the increased cost of virgin fiber and the demand for greater use of recycled fiber.

Therefore a dryer section or pressing section and dryer section combination is needed which increases paper strength and reduces dryer section length.

SUMMARY OF THE INVENTION

The papermaking machine of this invention employs a heated Extended Nip press following the pressing section. The heated Extended Nip press is an extension of Extended Nip pressing into high temperature impulse drying, i.e. high temperature pressing. The high temperature pressing raises the exit solids out of the press to the 55 to 70 percent range, resulting in improved strength and internal bonding. The web then enters the high intensity dryer section where the web is pressed onto a dryer roll and makes intimate contact with the roll where it can be dried to a range of up to approximately 90 percent solids. A coating on the dryer roll and the Extended Nip backing roll is composed of ceramic, metal, and a fluorocarbon which allows the web to be separated from the backing roll and the dryer roll with ease. The dryer roll is internally heated by steam or preferably gas to between 200° F. and 500° F. An aircap positioned over the web on the dryer blows hot air at a temperature of 200–500° F. at a velocity of 15,000 to 30,000 feet per minute onto the web.

As the web travels through the extended nip in the pressing section, the bottom side of the web is supported on a press felt, and the top side is pressed against the smooth surface of the pressing roll. As a result, the web comes out of the press having a smoother top side than the bottom or felt side. This two-sidedness is eliminated by pressing the bottom side against the high intensity dryer roll surface. Curl is controlled by drying both sides of the paper on the high intensity dryer roll at the same time.

A second embodiment can be used to dry the web down in two steps instead of one by employing a first and a second drying roll in the dryer section. The first apparatus has a first pressure roll that engages against the smooth surface of a first heated dryer roll to form a first nip with the roll. The two sided sheet leaving the press can be reversed by this first dryer so that the bottom side now becomes smoother than the top side. The second drying apparatus has a second pressure roll that engages against the smooth surface of a second heated dryer roll to form a second nip with the roll. The second dryer can now smooth the top side of the sheet to equal the bottom side. Both the first and second dryer roll are heated internally and externally. By proper adjustments of the heated Extended Nip, and the first and second high intensity dryers, a one-sided sheet can be produced.

In this second embodiment, the web again comes out of the pressing section and is transferred to the first pressure roll by a vacuum roll. The web is further pressed and dried as it travels through the first nip with the bottom side making contact with the smooth surface of the first roll. The web then travels through the second nip formed where a second pressure roll comes in contact with a second heated dryer roll.

For certain papers or lightweight board grade sheets, the sheet needs to have only one smooth side. This two-sidedness can be accomplished in a third embodiment in which the high temperature press is combined with a high intensity dryer to smooth the web topside surface only.

It is a feature of the present invention to provide an apparatus for reducing the combined length of the drying and pressing section of a papermaking machine.

It is another feature of the present invention to provide an apparatus for producing an improved strength and internal bonding in a paper or paperboard web.

It is a further feature of the present invention to provide a papermaking apparatus that requires less stock or stock of a lower cost to manufacture a particular strength or grade of paper or paperboard.

It is a still further feature of the present invention to provide a method for controlling the sidedness of the sheet using both the web pressing and drying process.

Further objects, features and advantages of the invention will be apparent from the following detailed description when taken in conjunction with the accompanying drawings.

DESCRIPTION OF THE PREFERRED EMBODIMENTS

Figure 1:
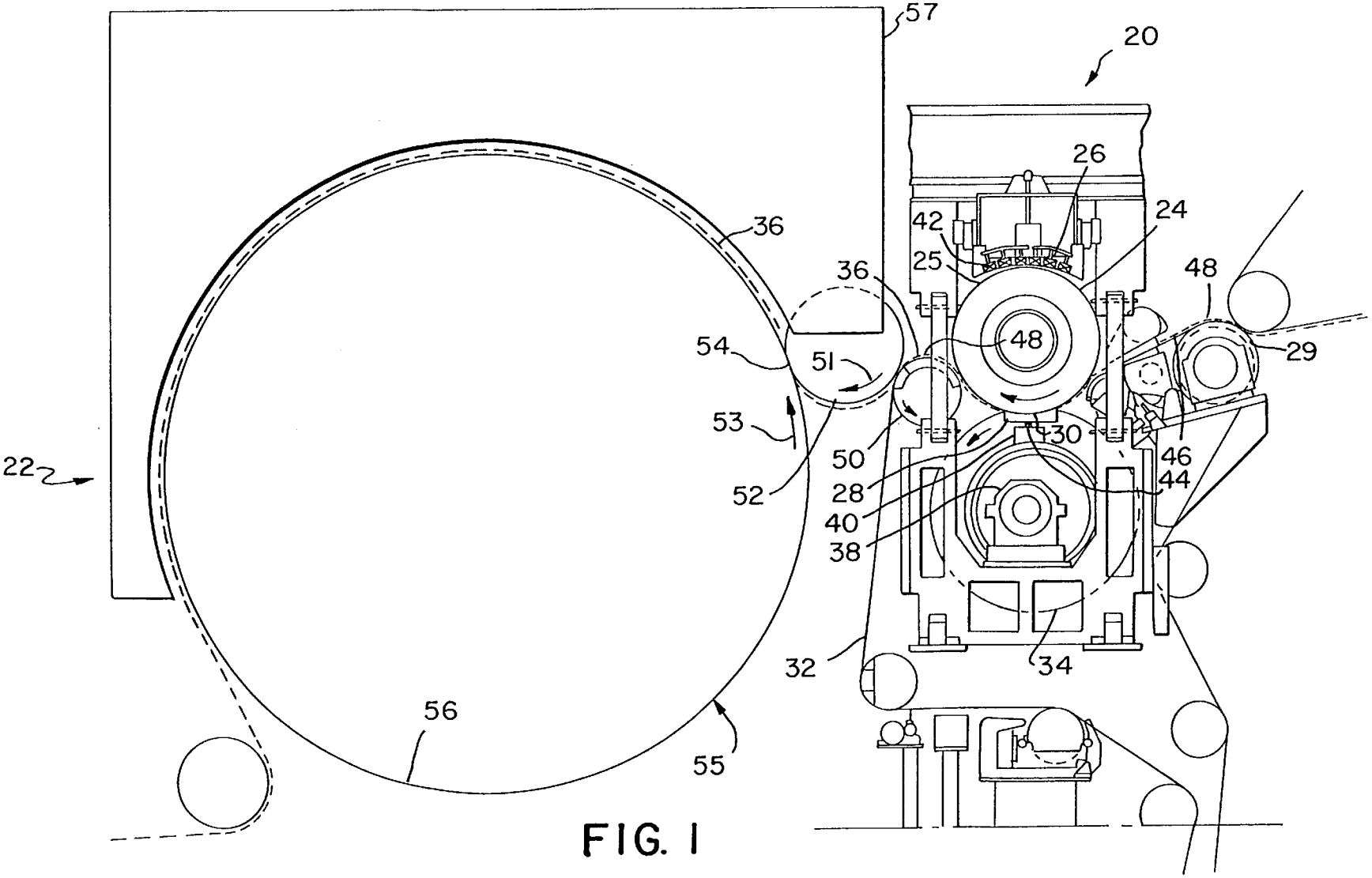
FIG. 1 is a schematic side elevational view of the high temperature press and high intensity dryer of the present invention.
Figure 2:
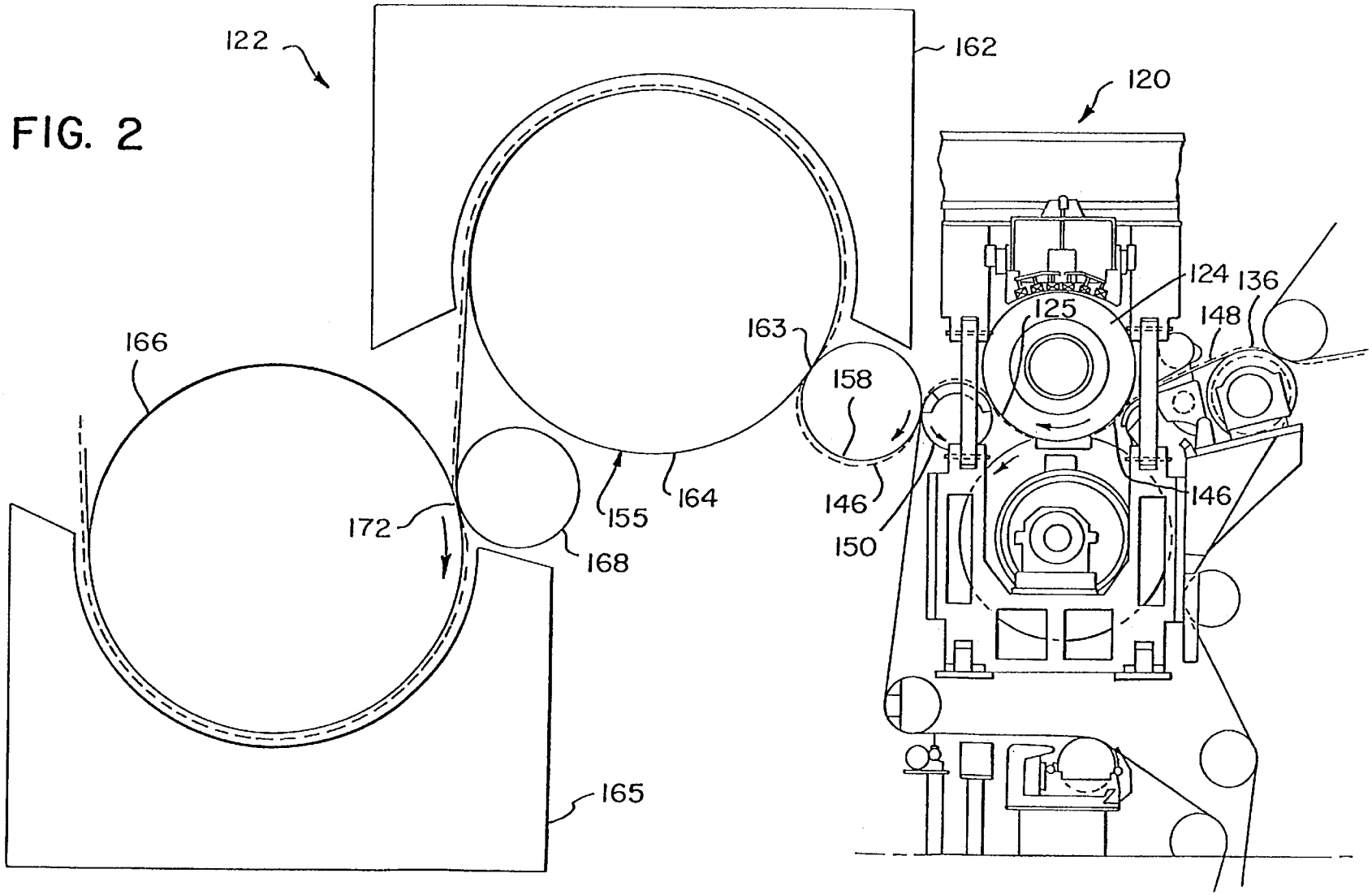
FIG. 2 is a schematic side elevational view of an alternative embodiment apparatus of the present invention employing two-step drying.
Figure 3:
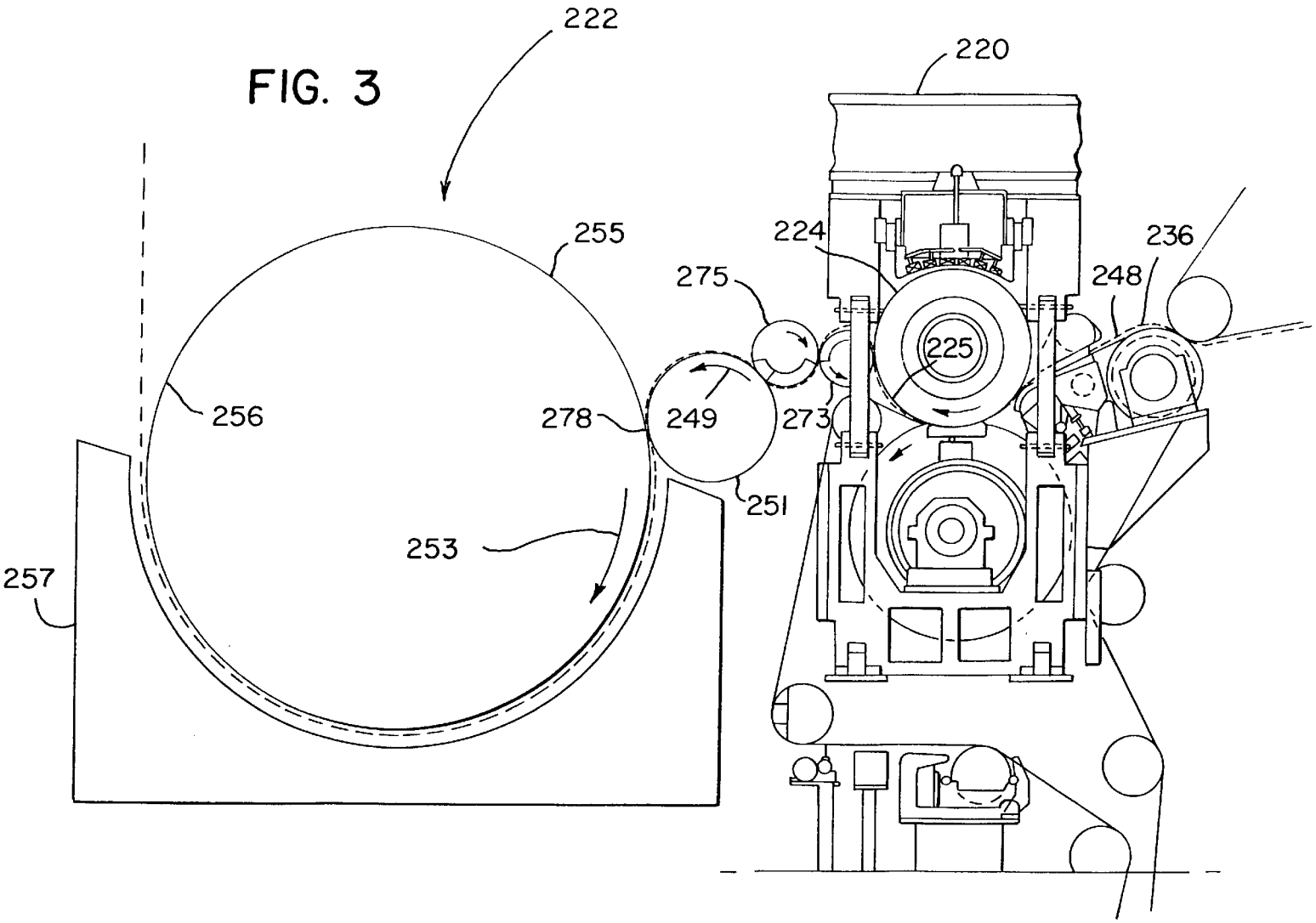
FIG. 3 is a schematic side elevational view of a still further embodiment of an apparatus of this invention for two-sided drying of a web.

Referring more particularly to FIGS. 1–3, wherein like numbers refer to similar parts, a combination high temperature Extended Nip press 20 and high intensity dryer 22 is shown in FIG. 1.

The combination of two recently developed improvements in the papermaking process, high temperature pressing and high intensity drying, produces a radically shortened dryer section with unique attributes. High temperature pressing utilizing a heated Extended Nip press 20 employs a not completely understood process in which a web from a conventional pressing section having a dry weight of thirty to forty percent fiber by weight is in a single press increased to between 55 and 65 percent dry weight. Some have suggested that the heated backing roll 24 causes steam to move rapidly through the web being pressed and drives liquid water from the web. Although not all agree on the mechanism involved the results are clear. Water is removed from the web without the energy cost associated with evaporating the water removed. At the same time the web is significantly improved in strength and internal bonding by twenty to thirty percent or more. The disadvantage of high temperature pressing is that the web produced is distinctly two sided.

High intensity drying is a technique long practiced for drying various grades of lightweight absorbent creped paper. The Yankee dryer is a large single dryer on which a light web is pressed. The web, because it is so tightly engaged with the Yankee dryer, experiences significantly higher heat transfer rates as compared to a conventional dryer. However the web must be removed by scraping from the dryer surface with a doctor blade. This is desirable where a high absorbency paper is desired.

Thus high intensity drying has two limitations, producing distinctly two sided paper and difficulty removing the web from the high intensity dryer without a doctor blade. By combining the two processes and by using modern release coating on the surface 25 of the backing roll 24 in the high temperature press and particularly on the surface 55 of the high intensity dryer 56 the problems associated with each system can be overcome. The result is a dryer section which can produce a one-sided web with a dry fiber content between seventy and ninety percent fiber by weight.

A web which is seventy percent dry fiber is suitable for finishing and/or coating to produce such paper grades as lightweight coated paper (LWC). A web which is ninety percent dry fiber is suitable for being wound on a reel. If the web is ninety percent dry fiber by weight it will normally increase to ninety-four to ninety-six percent by the time it reaches the reel.

The process of drying a paper web 36 with high temperature impulse drying and high intensity drying requires critical control of the water content of the web at each stage of the process. High water content during the initial high temperature pressing process helps to maintain the caliper or thickness of the paper and can influence the development of greater strength in the paper web. The water content in the web also prevents scorching of the paper by the heated backing roll in the Extended Nip press 20.

The successful functioning of the high intensity dryer 22 requires that the web be sufficiently high in moisture content that pressing on the dryer roll 56 achieves the intimate contact necessary to allow rapid heat transfer from the dryer to the web, and also to hold the web on the dryer as it is being dried by air from an aircap. At the same time, if the moisture content is too high the adhesion of the web to the high intensity dryer surface 55 will be too strong and it will be difficult to remove the web from the dryer surface. Thus it is important that the dry weight fiber content of the web as received from the pressing section be in the neighborhood of thirty to forty percent and it is critical that the dry weight fiber content of the web as it is pressed against the dryer roll be in the range of about fifty-five percent to about sixty-five percent.

The press 20 employs a backing roll 24 with a surface 25 that is heated by an induction heater 26. A shoe 28, having a concave surface facing towards the backing roll 24, is mounted so that it is urged towards the backing roll 24, forming a nip 30 between the backing roll 24 and the shoe 28. A press felt 32 moves over a continuous looped belt 34 and underlies a web of paper 36 as the web 36, felt 32, and belt 34 together pass through the nip 30 formed between the backing roll 24 and the shoe 28. Oil is supplied between the shoe 28 and the belt 34, causing a hydrodynamic wedge of fluid to build up between the belt 34 and the shoe 28. The fluid wedge transmits pressure to the web while at the same time lubricating the movement of the web 36 through the nip 30. The paper web 36, press felt 32, belt 34, and backing roll 24 are all in engagement at the nip 30 and are therefore driven at the same rate of speed. As a result, the paper web 36 does not experience significant sheer force at the nip 30 because there is no relative motion in the plane of the web 36, press felt 32, and surface 25 of the backing roll 24. Thus the paper web 36 is subject to principally compressive forces as it moves through the extended nip 30. The effect of the compressive force is to bring the web 36 into intimate contact with the surface of the backing roll 24.

The looped belt 34 is a continuous loop and has a cross-machine width greater than the cross-machine width of the backing roll 24 so that the ends of the belt (not shown) may be sealed to circular closures (not shown) which seal the ends of the belt so that the lubricating fluid is contained within the sealed belt 34. A stationary beam 38 is contained within the belt 34 and adjustably supports the shoe 28 by means of a piston 40 positioned in a piston chamber (not shown). The shoe 28 is pivotally supported on a roller pin 44, seated in a downward facing groove in the shoe 28 and an upward facing groove in the piston 40. The piston is urged upward by fluid pressure beneath the piston 40.

The backing roll 24, is of the crown control type in which the roll is internally supported by one or more hydraulic pistons.

The induction heater 26, shown schematically in FIG. 1, is conventional in nature and has coils 42 that are energized with high frequency alternating current to cause oscillating magnetic fields that induce eddy currents in the surface 25 of the backing roll 24. The induced currents produce resistance heating in the surface 25, heating it to the desired temperature. The backing roll 24 is heated to a temperature of between 300 to 500 degrees Fahrenheit before coming into contact with the web 36 at the nip 30.

The temperature, and load between the shoe 28 and the backing roll 24 at the nip 30, will depend upon the desired properties of the finished web. The combination of the time in the nip 30, the amount of pressure applied, and the roll temperature raises the exit solids of the web to the 55 to 65 percent range, and resulting in a 20 to 30 percent improvement of the physical properties. The resulting paper has improved strength and internal bonding, the extent of the improved property depending upon the furnish used to form the web 36.

In operation, the web 36 is brought into the heated Extended Nip press 20 at an infeed roll 29, so that the bottom side 46 of the web 36 is positioned on the press felt 32 as it is passed through the nip 30, and the web top side 48 is urged against the smooth surface of the backing roll 24. As a result, as the web leaves the press 20, the top side 48 is smoother than the bottom side 46, resulting in a two-sided web coming out of the high temperature press 20. As shown in FIG. 1, the web 36 is transferred from the belt supported felt 32 to a press roll 52 by a vacuum roll 50. The vacuum roll 50 transfers the web 36 to the roll 52 which is positioned against and forms a nip 54 with a dryer roll 56.

The dryer roll 56 is heated internally by a direct fire gas system or by steam. The web 36 is dried on the exterior of the dryer roll 56 by an aircap 57 which blows combustion gases and air heated to between 200° F. and 500° F. on the web top side 48. The heating gases are blown with a velocity of between 15,000 and 30,000 feet per minute. The direction of rotation of the press roll 52, indicated by arrow 51, is opposite the direction of rotation of the dryer roll 56, indicated by arrow 53, so that as the web 36 is transferred to the press roll 52 from the vacuum roll 50, it travels through the nip 54 to be brought into intimate engagement with the surface 55 of the dryer 56.

In addition to further drying the web 36, the bottom side 46 smoothness can be adjusted to equal the top side 48 smoothness by employing different combinations of pressure and dryer roll surface temperature. For example, the combination of heating the dryer roll 56 to temperatures of 200 to 300 degrees Fahrenheit and employing pressure of between 100 and 1000 PLI at the nip 54 can achieve the desired result of a one-sided web where the bottom side 46 smoothness is equal to the top side 48 smoothness.

Depending upon the contact time of the web 36 on the dryer roll 56, and the gas impingement conditions of the impingement cap 57, the sheet may be dried to over 70 percent solids. Using large diameter drums, such as Yankee rolls, as the dryer roll 56, can even achieve dryness over 80 percent solids to even completely dry the sheet to 90 percent solids.

The success of the combination of high temperature pressing and high intensity drying required for most applications requires producing a one-sided sheet by balancing the temperature and pressure of the high temperature press 20 and the high intensity dryer 22. Further curl of the paper can be controlled by varying the amount of drying taking place through the upper side of the web. Two sided drying on the dryer 56 is controlled by varying the temperature of the dryer and the temperature of the air and the velocity of the air which is blown on to the upper side of the web.

For certain furnishes, desired results are best achieved by drying the web 36 in two steps as shown in FIG. 2. In this embodiment, the dryer section 122 has a first high intensity dryer roll 164 with an aircap 162 and a second high intensity dryer roll 166 with a second aircap 165. A web 136 enters the high temperature Extended Nip press 120 where the upper side 148 of the web engages the smooth surface 125 of the backing roll 124.

The web 136 is transferred from the press 120 by a vacuum roll 150 to a first pressure roll 158. The bottom side 146 of the web is pressed against the smooth surface 155 of a first heated dryer roll 164, at a first nip 163 formed between the pressure roll 158 and the dryer roll surface 155. The dryer roll 164 is heated by an aircap 162. The combination of pressure and temperature can make the bottom side 146 smoother than the top side 148. After the web 136 is partially dried down in the first drying apparatus 64, it is transferred to the second dryer roll 166 by a second pressure roll 168. The second heated dryer roll 166 has an aircap 165.

Because it becomes harder to achieve the intimate contact necessary for high intensity drying as the web becomes dryer, the amount of moisture removed on the first dryer roll 164 must be controlled so that sufficient moisture remains to allow the web to be pressed into engagement with the second dryer 166. Greater pressure between the second pressure roll 168 and the dryer roll 166 facilitates creating the intimate contact required to achieve the desired drying rates. The top side 148 is pressed as it passes through a nip 172 formed where the pressure roll 168 comes in contact with the dryer roll 166 so that the smoothness of the top side 148 of the web 136 is equal to the smoothness of the bottom side 146. The second drying apparatus 66 will further dry the web 136 so that the solids content is approximately 90 percent.

The second dryer 166 provides more flexibility in achieving one-sidedness in the web 136. By varying the temperature and pressure in the Extended Nip Press 120, and the temperatures of the first and second dryers, pressures of the pressing rolls, and the air temperature and velocity in air caps associated with each dryer a one-sided sheet can be produced from a broader ranged of furnishes.

For certain papers, or lightweight board grade sheets, it is desired to have only one smooth side. Where a sheet having only a single smooth side is required a third embodiment, the dryer section 222 shown in FIG. 3, can be employed. The web 236 is transferred from the Extended Nip Press 220 to the dryer section 222 by a vacuum roll 273. The vacuum roll 273 transfers the web 236 to a second vacuum transfer roll 275. The effect of the second vacuum transfer roll 275 is to allow a press roll 251 to bring the top side 248 of the web 236 into engagement with the surface 255 of the dryer 256. Both the surface 225 of the backing roll 224 and the surface 255 of the dryer roll 256 engage the same side of the paper web 236 thereby producing a paper web with one side substantially smoother than the other.

The web 236 is pressed by the press roll 251 against the smooth surface 255 of the dryer roll 256 with a pressure of between 100 and 1000 lb per linear inch at the nip 278. The dryer roll 256 is heated internally by steam or gas to between 200° F. and 500° F. The web 236 while on the dryer surface 255 is also dried with an aircap 257 with heated air at a temperature of 200° F. to 500° F. which is blown onto the web at a velocity of 15,000 to 30,000 feet per minute. The dryer roll 256 and press roll 258 rotate in the direction of rotation indicated by arrows 249, 253.

Development of the release characteristics of the backing roll 24, 124. 224 in the high temperature press 20,120, 220 and particularly the release characteristics of the dryer rolls 56, 164, 166, and 256 requires a modem release coating being applied to the roll surfaces. A typical coating applied to the dryer roll surface 55 or the surface 25 of the backing roll 24 by plasma spraying will consist of three distinct ingredients: a metal of good release characteristics, a ceramic, and a fluorocarbon such as Teflon®. The various components will be adjusted depending on the furnish and the basis weight and the process variables.

The metal components can be from 0 to 75 percent by volume of the coating, the fluorocarbon can be five to forty percent by volume with ceramic making up the balance. While the metal can be any metal that can be thermal sprayed, the preferred metal is an alloy composed of iron, nickel, chromium, boron, silicon, molybdenum, copper, and carbon, said alloy comprising 5 to 30 percent by volume of the coating.

A metal composition with good release characteristics is an alloy with the following composition: thirteen to sixteen percent molybdenum, twenty-eight to thirty percent nickel, thirty to thirty-four percent chromium, 1.2 to 1.8 percent silicon, 3 to 4.5 percent boron, 0.2 percent or less carbon, and copper between 3 and 3.8 percent with the balance being iron. This composition is a modification of Armacor C alloy. Armacor C is available from Amorphous Metal Technologies, Inc., 1005 Meuirlands, Suite 5, Irvine, Calif. 92718.

The coating described herein is typically applied by flame or plasma spraying in the form of a metal powder or wire which is melted and sprayed onto the cylindrical roll surface of the stainless steel, steel or iron roll. To improve the bonding between the coating and the roll surface, the roll may be first coated with a bonding coating consisting of a chromium and nickel mixture, for example, a 60 percent nickel, 40 percent chromium alloy, which is then overlaid with the special release coating such as disclosed above. The current preferred material will have a composition of 10 to 30 percent metal and 10 to 20 percent Teflon® with the balance ceramic. The material used for the coating is very dependent on composition of sheet furnish. Thus to cover all conceivable furnishes to date the metal component may range from 0 to 75 percent by volume, the fluorocarbon from 5 to 40 percent by volume, with the ceramic making up the balance.

An acceptable ceramic is alumina containing two-three percent titania. Other ceramics which can be used are comprised of one of or a mixture of the following materials; alumina, titania, silica, zirconia, chromia, or magnesia. The fluorocarbon is preferably Teflon®, but any fluorocarbon or silicone release material should work.

To achieve best web release results, appropriate roll coating is one variable which may need to be adjusted along with or in response to variations in furnish, roll temperature in the press 20 and in the dryer 22, pressure at the Nip 54 formed between the press rolls 52 and the dryer 56, as well as the temperature and velocity of the air in the aircap 57.

It should be understood that the combination of a high temperature press followed by high intensity drying will be most practical with lightweight paper grades particularly those of less that one-hundred grams per square meter. In addition, it should be understood that the term "without a doctor blade" means that any doctor blade engaged with the dryer roll 56 does not scrape the web 36 from the surface of the dryer during normal production of the paper web.

Furthermore, where induction heaters are shown and described in the press section, other types of heaters including but not limited to infrared heaters, direct flame impingement heaters, hot gas heaters, or steam heaters could be employed. It should be understood that the dryer rolls 56, 164, 166, 256 will preferably be wrapped by the web 36, 136, 236 at least about 180 degrees around the dryer surface.

It is understood that the invention is not limited to the particular construction and arrangement of parts herein illustrated and described, but embraces such modified forms thereof as come within the scope of the following claims.

We claim:

1. A method of drying a paper web in a papermaking machine comprising the steps of:

receiving a paper web from a pressing section having a solids content of between about thirty percent and about forty-five percent;

pressing the web between a surface of a backing roll and a blanket supported on a shoe wherein the surface of the backing roll is heated between about 300° F. and about 500° F.;

raising the solids content of the web to between about fifty-five percent and about sixty-five percent;

pressing the web in a nip formed between a heated dryer roll surface and a press roll after the solids content has been raised to between about fifty-five percent and about sixty-five percent with a force of between 100 and 1,000 pounds per linear inch of nip in the cross machine direction, wherein the dryer roll surface is heated to between about 200° F. and about 500° F.;

blowing gas of a temperature of between about 200° F. and about 500° F. at a velocity of between about 15,000 and about 30,000 feet per minute on to the web on the dryer roll surface; and removing the web from the dryer roll without a doctor blade.

2. The method of claim 1 further comprising the steps of:

pressing the web after it is removed from the heated dryer roll onto a second heated dryer roll with a force of between 100 and 1000 pounds per linear inch; and blowing gas of a temperature of between about 200° F. and about 500° F. at a velocity of between about 15,000 and about 30,000 feet per minute on to the web on the second heated dryer roll.

3. The method of claim 1 wherein a single vacuum transfer roll is positioned between the backing roll and the press roll so that a side of the web which engages the backing roll does not engage the dryer roll.

4. The method of claim 1 wherein a first vacuum transfer roll and a second vacuum transfer roll are positioned between the backing roll and the press roll so that a side of the web which engages the backing roll also engages the dryer roll.

5. The method of claim 1 wherein the dryer roll has a surface coating consisting of a metal of good release characteristics, a ceramic, and a fluorocarbon.

6. The method of claim 5 wherein the metal component is an alloy composed of iron, nickel, chromium, boron, silicon, and carbon and makes up 5 to 30 percent by volume of the coating; the fluorocarbon is five to forty percent by volume, with the ceramic making up the balance, wherein the ceramic is selected from the group consisting of, alumina containing two to three percent titania, alumina titania, silica, zirconia chromia, and magnesia.

7. A method of drying a paper web and a papermaking machine comprising the steps of:

passing a web having an upper side and a lower side and having a solids content of about 30 percent to about 45 percent through a nip formed between a heated backing roll and a shoe and removing sufficient water to increase the solids content of the web to between about 55 to about 65 percent;

following the step of increasing the solids content of the web pressing the web against a surface of a dryer roll with a nip pressure of between 100 and 1000 lb per linear inch to bring the web into intimate engagement with the dryer surface heating the dryer roll surface to between 200° F. and 500° F. while the web maintains engagement with the dryer surface; and blowing gases having a temperature between about 200 and about 500° F. on to the web while it is engaged with the dryer surface, at a velocity of between about 15,000 feet per minute and about 30,000 feet per minute.

8. The method of claim 7 further comprising the steps of:

pressing the web after it is removed from the heated dryer roll onto a second heated dryer roll with a force of between 100 and 1000 pounds per linear inch; and blowing gas of a temperature of between about 200 and about 500° F. at a velocity of between about 15,000 and about 30,000 feet per minute on to the web on the second dryer surface.

9. The method of claim 7 wherein a single vacuum transfer roll is positioned between the backing roll and the press roll so that a side of the web which engages the backing roll does not engage the dryer roll.

10. The method of claim 7 wherein a first vacuum transfer roll and a second vacuum transfer roll are positioned between the backing roll and the press roll so that a side of the web which engages the backing rolls also engages the dryer roll.

11. The method of claim 7 wherein the dryer roll has a surface coating consisting of three distinct ingredients, a metal of good release characteristics, a ceramic, and a fluorocarbon.

12. The method of claim 11 wherein the metal component is an alloy composed of iron, nickel, chromium, boron, silicon, and carbon and makes up 5 to 30 percent by volume of the coating, the fluorocarbon is five to forty percent by volume, with ceramic making up the balance, wherein the ceramic is selected from the group consisting of, alumina containing two to three percent titania, alumina titania, silica, zirconia chromia, and magnesia.

13. An apparatus for drying a paper web from a pressing section comprising:

a press having a backing roll with a temperature of between 300° F. and 500° F. and a shoe opposed to the backing roll and forming a nip with the backing roll;

a paper web passing through the nip formed by the backing roll and the shoe and having a dry fiber content as it leaves the nip of between 55 percent and 65 percent, a vacuum roll forming a nip with the backing roll and engaging the paper web and wrapping the paper web about the vacuum roll;

a press roll forming a nip with the vacuum roll and receiving the paper web from the backing roll;

a dryer roll having a surface with a temperature between 200° F. and 500° F., the dryer roll forming a nip with the press roll, wherein the press roll is biased against the dryer roll with a force of between 100 and 1,000 lb per linear inch and wherein the paper web wraps at least about 180 degrees around the dryer surface;

an aircap positioned over the web as it wraps around the dryer surface, the aircap directing gases heated to between 200° F. and 500° F. at a velocity of between 15,000 and 30,000 feet per minute onto the web; and wherein the apparatus has no more than two dryer rolls.

14. The apparatus of claim 13 wherein the dryer roll has a surface coating consisting of a metal of good release characteristics, a ceramic, and a fluorocarbon.

15. An apparatus for driving a paper web from a pressing section comprising:

a press having a backing roll with a temperature of between 300° F. and 500° F. and a shoe opposed to the backing roll and forming a nip with the backing roll;

a paper web passing through the nip formed by the backing roll and the shoe and having a dry fiber content as it leaves the nip of between 55 and 65 percent;

a vacuum roll forming a nip with the backing roll and engaging the paper web and wrapping the paper web about the vacuum roll;

a press roll forming a nip with the vacuum roll and receiving the paper web from the backing roll;

a dryer roll having a surface with a temperature between 200° F. and 500° F. the dryer roll forming a nip with the press roll, wherein the press roll is biased against the dryer roll with a force of between 100 and 1,000 lb per linear inch and wherein the paper web wraps at least about 180 degrees around the dryer surface; and an aircap positioned over the web as it wraps around the dryer surface, the aircap directing gases heated to between 200° F. and 500° F. at a velocity of between 15,000 and 30,000 feet per minute onto the web, wherein the dryer roll has a surface coating consisting of a metal of good release characteristics; a ceramic; and a fluorocarbon and wherein the metal component is an alloy composed of iron, nickel, chromium, boron, silicon, and carbon and makes up 5 to 30 percent by volume of the coating; the fluorocarbon is five to forty percent by volume with ceramic making up the balance; wherein the ceramic is selected from the group consisting of alumina containing two to three percent titania, alumina titania, silica, zirconia chromia, and magnesia.

16. The apparatus of claim 15 further comprising:

a second press roll;

a second heated dryer roll wherein the second press roll is engaged with the second dryer roll with a force of between 100 and 1,000 pounds per linear inch, and wherein the paper web passes between the second press roll and the second dryer roll and wraps at least above 180 degrees of the second dryer roll; and a second aircap directing gas on the web at a temperature of between about 200° F. and about 500° F. at a velocity of between about 15,000 and about 30,000 feet per minute.

17. The apparatus of claim 15 wherein the web has a first side which engages the backing roll and a second side opposite the first side which engages the dryer.

18. The apparatus of claim 15 further comprising a second vacuum roll positioned between the vacuum roll and the press roll so that a first side of the web which engages the backing roll also engages the dryer roll.

* * * * *